US009655404B2

(12) United States Patent
Wakeland et al.

(10) Patent No.: US 9,655,404 B2
(45) Date of Patent: May 23, 2017

(54) CONTOURED INSOLES FOR FOOTWEAR

(71) Applicant: Superfeet Worldwide, Inc., Ferndale, WA (US)

(72) Inventors: Dan Wakeland, Bellingham, WA (US); Jeff Gray, Ferndale, WA (US); Matthew Warren Gooch, Ferndale, WA (US)

(73) Assignee: Superfeet Worldwide, Inc., Ferndale, WA (US)

( * ) Notice: Subject to any disclaimer, the term of this patent is extended or adjusted under 35 U.S.C. 154(b) by 272 days.

(21) Appl. No.: 14/304,747

(22) Filed: Jun. 13, 2014

(65) Prior Publication Data

US 2014/0366399 A1 Dec. 18, 2014

Related U.S. Application Data

(60) Provisional application No. 61/835,442, filed on Jun. 14, 2013.

(51) Int. Cl.

| | |
|---|---|
| ***A43B 17/00*** | (2006.01) |
| ***A43B 13/38*** | (2006.01) |
| ***A43B 17/16*** | (2006.01) |
| ***A43B 1/00*** | (2006.01) |
| ***A43B 7/14*** | (2006.01) |
| ***A43B 17/08*** | (2006.01) |
| ***A43B 17/18*** | (2006.01) |

(52) U.S. Cl.

CPC ..... *A43B 13/386* (2013.01); *A43B 1/0009* (2013.01); *A43B 7/141* (2013.01); *A43B 7/142* (2013.01); *A43B 7/144* (2013.01); *A43B 17/006* (2013.01); *A43B 17/08* (2013.01); *A43B 17/16* (2013.01); *A43B 17/18* (2013.01)

(58) Field of Classification Search

CPC ..... A43B 13/38; A43B 13/386; A43B 13/41; A43B 17/00; A43B 17/006; A43B 17/16

USPC ..... 36/43, 44

See application file for complete search history.

(56) References Cited

U.S. PATENT DOCUMENTS

| | | | | | |
|---|---|---|---|---|---|
| 4,070,770 | A * | 1/1978 | Vello | A43B 5/003 | 36/43 |
| 4,435,910 | A * | 3/1984 | Marc | A43B 5/06 | 36/173 |
| 4,586,273 | A * | 5/1986 | Chapnick | A43B 7/142 | 36/154 |
| 4,718,179 | A * | 1/1988 | Brown | A43B 7/141 | 36/173 |
| 4,879,821 | A * | 11/1989 | Graham | A43B 7/142 | 36/140 |
| 5,003,708 | A * | 4/1991 | Daley | G01B 5/207 | 36/44 |
| 6,070,342 | A * | 6/2000 | Brown | A43B 7/142 | 36/174 |

(Continued)

*Primary Examiner* — Marie Bays

(74) *Attorney, Agent, or Firm* — Lowe Graham Jones PLLC

(57) ABSTRACT

An insole assembly for use in footwear is provided. The insole assembly generally includes a full-length insole base made of a flexible and resilient material (e.g., resiliently compressible foam), and a heel cap made of a generally rigid material (e.g., a carbon fiber reinforced polymer) which is attached to the insole base and mimics the contours thereof to provide proper biomechanical support of the heel and arch areas of a foot in a particularly lightweight and sleek form factor.

28 Claims, 6 Drawing Sheets

(56) References Cited

U.S. PATENT DOCUMENTS

| | | | | |
|---|---|---|---|---|
| 6,233,847 | B1 * | 5/2001 | Brown | A43B 7/142 36/174 |
| 6,618,960 | B2 * | 9/2003 | Brown | A43B 7/142 36/174 |
| 7,107,705 | B2 * | 9/2006 | Dalton | A43B 7/142 36/28 |
| 7,484,319 | B2 * | 2/2009 | Cheskin | A43B 7/141 36/144 |
| 7,665,169 | B2 * | 2/2010 | Cheskin | A43B 7/141 12/146 B |
| 7,908,768 | B2 * | 3/2011 | Cheskin | A43B 7/141 36/144 |
| 7,958,653 | B2 * | 6/2011 | Howlett | A43B 7/142 36/35 R |
| 8,042,287 | B2 * | 10/2011 | Reinhardt | A43B 7/141 36/179 |
| 8,250,784 | B2 * | 8/2012 | Cheskin | A43B 7/141 36/144 |
| 2002/0056208 | A1 * | 5/2002 | Brown | A43B 7/142 36/44 |
| 2006/0016099 | A1 * | 1/2006 | Marco | A43B 7/1435 36/43 |
| 2007/0033834 | A1 * | 2/2007 | Cheskin | A43B 7/141 36/44 |
| 2009/0151194 | A1 * | 6/2009 | Cheskin | A43B 7/141 36/28 |
| 2010/0095552 | A1 * | 4/2010 | Cheskin | A43B 7/141 36/44 |
| 2010/0126044 | A1 * | 5/2010 | Davis | A43B 1/0009 36/108 |
| 2011/0131835 | A1 * | 6/2011 | Cheskin | A43B 7/141 36/44 |
| 2012/0272546 | A1 * | 11/2012 | Tsai | A43B 3/0078 36/44 |
| 2013/0185957 | A1 * | 7/2013 | Tsai | A43B 17/006 36/44 |
| 2013/0326906 | A1 * | 12/2013 | Howlett | A43B 7/142 36/44 |
| 2015/0000159 | A1 * | 1/2015 | Howlett | A43B 7/142 36/44 |

* cited by examiner

CONTOURED INSOLES FOR FOOTWEAR

TECHNICAL FIELD

This disclosure generally relates to insoles for footwear and, more particularly, to a contoured insole assembly having a flexible full-length insole base and a rigid reinforcement cap which underlies the heel end of the insole base so as to provide support at predetermined areas.

DESCRIPTION OF THE RELATED ART

Cushioning insoles of various types are known for use in footwear, particularly for use in running shoes and other footwear intended for athletic activities. Typically, these insoles take the form of a relatively thin layer of foam material which rests atop the midsole of the footwear, and are often removable for washing or replacement. While commonly used, conventional insoles of this general type have proven less than ideal in several respects. For example, the top surface of the foam material is often given a pronounced contour in an effort to support and cradle the wearer's foot, but because the foam is intended mainly to cushion the foot, it typically lacks sufficient strength and firmness to simultaneously provide the necessary support for proper biomechanical function of the foot, particularly in the heel and arch areas.

Other insoles are known which provide effective cushioning for a foot while also providing greater support in the heel and arch areas so as to optimize the biomechanical motions of the foot. Examples of such insoles include the BLUE, GREEN and BLACK premium insoles sold by Superfeet Worldwide, Inc. of Ferndale, Wash. Other examples are shown and described in Superfeet Worldwide's U.S. Pat. No. 6,233,847, which is incorporated herein by reference in its entirety.

BRIEF SUMMARY

The insole assemblies for footwear shown and described herein are configured to provide enhanced foot support in particularly lightweight and sleek form factors. Embodiments are also particularly well adapted to fit within footwear of varying configurations. The insole assemblies generally include a full-length insole base made of a flexible and resilient material and a rigid heel cap attached thereto that mimics the contours of insole base to provide proper biomechanical support of the heel and arch areas of a foot in a particularly lightweight and sleek form factor.

At least one embodiment of an insole assembly to be inserted in footwear to provide foot support may be summarized as including a flexible full-length insole base and a rigid heel cap coupled thereto. The insole base has an upper contoured surface for engaging a plantar surface of a foot and a lower contoured surface opposite the upper contoured surface. The heel cap has an upper contoured surface and a lower contoured surface opposite the upper contoured surface with the same general contours as the upper contoured surface to define a thin shell structure. The heel cap is bonded to the insole base with the upper contoured surface of the heel cap in contact with the lower contoured surface of the insole base to underlie at least a heel portion thereof and provide support thereto. The heel cap may also include a plurality of engagement features protruding from the lower contoured surface thereof to engage a midsole of the footwear during use and to resist motion of the insole assembly relative to the midsole. The insole base may comprise a resiliently compressible foam material and the heel cap may comprise a carbon fiber reinforced polymer material.

The upper contoured surface of the heel cap may have contours that are the same general contours as the lower contoured surface of the heel portion of the insole base such that the heel cap and the insole base nest closely together.

A thickness of the thin shell structure defined between the upper and the lower contoured surfaces of the heel cap may be generally uniform throughout an entirety of the heel cap. In some instances, the thickness of the thin shell structure defined may be exactingly uniform. In other instances, the thickness of the thin shell structure defined between the upper and the lower contoured surfaces of the heel cap may narrow slightly with increasing distance away from a heel end of the heel cap, or otherwise vary slightly along the length of the heel cap. In some instances, an entirety of the heel cap may be located within a reference boundary that is offset from the lower contoured surface of the insole base by a thickness of the insole base. In other instances, an entirety of the heel cap apart from the plurality of engagement features may be located within a reference boundary that is offset from the lower contoured surface of the insole base by a thickness of the insole base.

When provided, the plurality of engagement features protruding from the lower contoured surface of the heel cap may comprise a series of elongated, intersecting ridges. The series of elongated ridges may intersect to provide enhanced structural integrity to at least a rear portion of the heel cap and may intersect to form isolated regions of the lowered contoured surface of the heel cap. At least some of the isolated regions may have a general diamond shape. Apart from the series of intersecting ridges, the heel cap may lack any other projections in a heel region thereof.

A rear heel portion of the upper contoured surface of the heel cap may be rounded and concave to cup a heel of a user, and a corresponding heel portion of the lower contoured surface of the heel cap may mimic the upper contoured surface such that an entirety of the corresponding heel portion is similarly rounded and concave.

In some instances, the forefoot portion of the insole base may include a beveled edge region extending along a periphery thereof. The beveled edge region may taper toward a point at the upper contoured surface of the insole base such that a thickness of the base increases with increasing distance inwardly away from an outer edge of the forefoot portion.

The insole base may extend beyond the outer periphery of the heel cap in all directions. A width of the heel cap at a location midway between opposing ends of the heel cap may be substantially less than a width of the insole base at a corresponding location. For example, the width of the heel cap at the location midway between opposing ends of the heel cap may be at least 0.25 inch less than the width of the insole base at the corresponding location. In some instances, a width of the heel cap may be less than a corresponding width of the insole base along an entire length of the heel cap.

The forefoot portion of the insole base may include a series of depressions formed on the lowered contoured surface thereof. A depth of the series of depressions may vary over a length thereof. For example, the depth of the series of depressions may decrease with increasing distance from a toe end of the insole assembly.

The insole base may further include an array of perforations extending completely through at least one of the forefoot and midfoot portions of the insole base. For example, the insole base may include a first array of circular apertures extending completely through a region of the forefoot portion and a second array of circular apertures extending completely through a region of the midfoot portion.

The various aspects and features described above and other aspects and features described herein may be combined to provide insole assemblies that are particularly well adapted to support a user's foot in a particularly lightweight and sleek form factor. It is appreciated that such insole assemblies may be used in conjunction with a wide range of footwear, including without limitation, athletic shoes, casual shoes, dress shoes, work boots and recreational footwear such as snowboard boots and ski boots.

DETAILED DESCRIPTION

Figure 1:
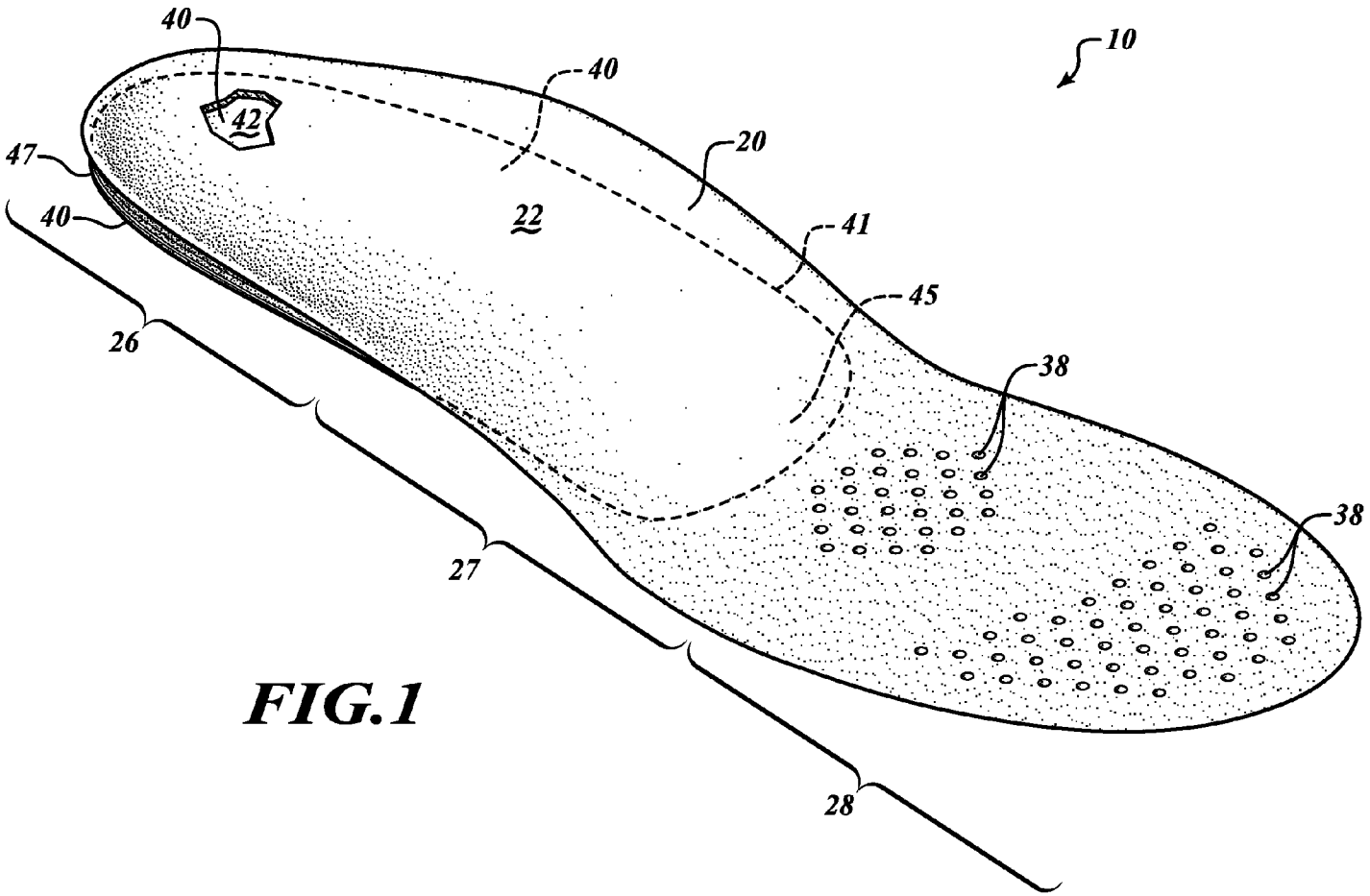
FIG. 1 is an isometric top view of an insole assembly, according to one example embodiment.

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with insoles for footwear and orthotic devices may not be shown or described in detail to avoid unnecessarily obscuring descriptions of the embodiments. For example, it will be appreciated that the full-length insole base on the insole assemblies described herein may include an upper fabric lining with or without antibacterial properties that is adhered or otherwise bonded to or formed with the full-length insole.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 1 through 9 show an insole assembly 10 for footwear, according to one example embodiment, and more particularly, a right-side insole assembly 10 of a pair of symmetrically formed insole assemblies. The insole assembly 10 includes a full-length insole base 20 and a rigid heel cap 40 coupled thereto.

According to some embodiments, the insole base 20 may comprise a resiliently compressible foam material. The resiliently compressible foam material may be formed by an irradiation process which minimizes the size of air pockets formed therein and may lead to a reduction in weight of the resulting insole base 20 relative to insoles formed of chemically cross-linked foams, for example. This may result in an insole base 20 that is particularly lightweight yet sufficiently resilient to provide adequate cushioning and durability.

According to some embodiments, the rigid heel cap 40 may comprise a carbon fiber reinforced polymer material. The carbon fiber reinforced polymer material may comprise, for example, a polymer blend having up to or exceeding ten percent of carbon fibers by mass or volume to enhance the structural rigidity of the heel cap 40. This may result in a heel cap 40 that is particularly lightweight yet sufficiently rigid to provide adequate biomechanical support of a user's foot when combined with the base insole 20 to form the insole assembly 10.

Figure 6:
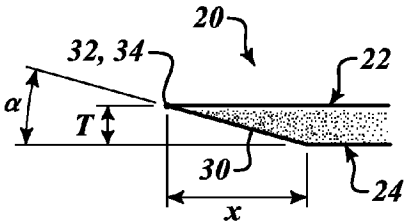
FIG. 6 is an enlarged detail view of a toe end of the insole assembly of FIG. 1.
Figure 7:
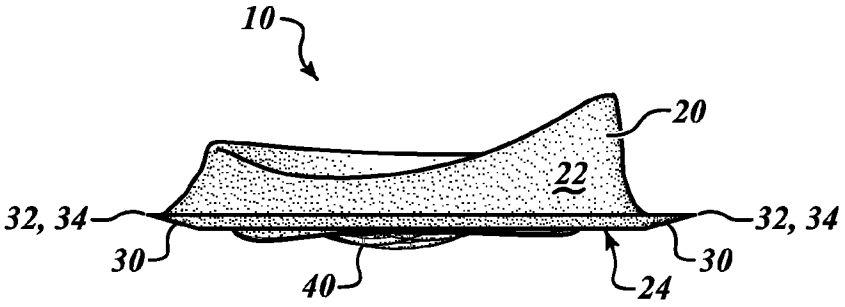
FIG. 7 is a front elevational view of the insole assembly of FIG. 1.
Figure 8:
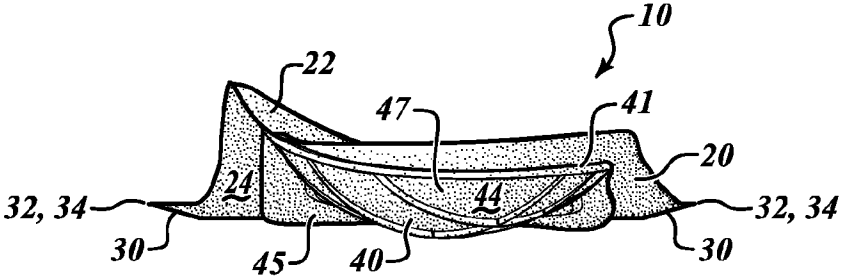
FIG. 8 is a rear elevational view of the insole assembly of FIG. 1.

With continued reference to the example embodiment of the insole assembly 10 shown in FIGS. 1 through 9, the insole base 20 includes an upper contoured surface 22 for engaging a plantar surface of a user's foot and a lower contoured surface 24 opposite the upper contoured surface 22. The upper contoured surface 22 and the lowered contoured surface 24 are offset from each other and define a generally uniform thickness T (FIG. 6). The insole base 20 also includes a heel portion 26 to engage and support a heel of the user's foot, a forefoot portion 28 to support a forefoot of the user's foot, and a midfoot portion 27 located therebetween.

The rigid heel cap 40 includes an upper contoured surface 42 (FIG. 1) and a lower contoured surface 44 opposite the upper contoured surface 42. The lower contoured surface 44 has the same general contours as the upper contoured surface 42 and is offset therefrom to define a thin shell structure of substantially uniform thickness, as shown best in the cross-section view of FIG. 9. In some embodiments, the thickness of the thin shell structure defined between the upper and lower contoured surfaces 42, 44 may be exactingly uniform. In other instances, the thin shell structure defined between the upper and lower contoured surfaces 42, 44 may vary slightly in thickness along a length of the heel cap 40 yet still remain generally uniform. For example, a thickness of the heel cap 40 may taper towards the leading end 45, as shown, for example, in FIG. 9.

The heel cap 40 may being bonded, such as, for example, via adhesive, to the insole base 20 with the upper contoured surface 42 of the heel cap 40 in contact with the lower contoured surface 24 of the insole base 20 to underlie at least the heel portion 26 thereof and provide support thereto. The upper contoured surface 42 of the heel cap 40 may have contours that are the same general contours as the lower contoured surface 24 of the heel portion 26 of the insole base 40 such that the heel cap 40 and the insole base 20 nest closely together in an assembled configuration. Collectively, the insole base 20 and the heel cap 40 provide a contoured support structure for engaging the plantar surface of a user's foot and for providing proper biomechanical support of the heel and arch areas of the foot during use of the insole assembly 10.

As can be appreciated from the example embodiment shown in FIGS. 1 through 9, the heel cap 40 may extend from a heel or aft end of the insole assembly 10 toward a toe of fore end thereof and may include a leading end 45 that terminates in a region aft of where the metatarsal heads or ball of a user's foot is expected to contact the insole base 20. Accordingly, the rigid heel cap 40 may provide support predominately to the rearfoot and midfoot while enabling the user's foot to flex and extend in a natural manner about the metatarsophalangeal joints. The leading end 45 of the heel cap 40 may be particularly rigid and resistant to large amounts of deflection. In addition, the leading end 45 of the heel cap 40 may be configured to have a flexural rigidity or bending stiffness that is similar to that of the remainder of the heel cap 40 such that the heel cap 40 has a more uniform resistance to bending forces over a length thereof. This is opposed to reinforcement caps for insoles that may have more asymmetrical properties, such as, for example, a heel portion which has a flexural rigidity or bending stiffness that is an order or several orders of magnitude greater than an opposing end portion thereof, such as, for example, as the result of posts or other stiff features that may be predominately located in the aft end of the reinforcement cap. Advantageously, a heel cap 40 having a well-balanced stiffness or rigidity profile may result in a "balanced feel" across the entirety of the plantar surface of the user's foot during use. This should also help to reduce strain in the plantar fascia and reduce the resistance of the foot to supinating. In addition, the shape and rigidity of the leading end 45 of the heal cap 40 may assist in improving the function of the windlass mechanism by making the big toe easier to dorsiflex during the gait cycle.

With continued reference to FIGS. 1 through 9, the heel cap 40 may further include a plurality of engagement features 48 that protrude from the lower contoured surface 44 of the heel cap 40 to engage the midsole of the shoe or other footwear in which the insole assembly 10 is inserted for use. The engagement features 48 may be configured to resist motion of the insole assembly 10 relative to the midsole and to provide enhanced structural integrity to at least a rear portion or aft end 47 of the heel cap 40. As an example, the heel cap 40 may include engagement features 48 in the form of a series of elongated ridges that protrude from the lower contoured surface 44 of the heel cap 40 to engage or "bite" into the midsole and that stiffen the aft end 47 of the heel cap 40. In some instances, the elongated ridges or other engagement features 48 may intersect to provide enhanced structural integrity to at least the aft end 47 of the heel cap 40. The elongated ridges or other engagement features 48 may intersect to form isolated regions 50 of the lowered contoured surface 44 of the heel cap 40, such as, for example, the generally diamond-shaped regions 50 shown in FIGS. 2 and 3. The elongated ridges or other engagement features 48 may run generally diagonally from the aft end 47 of the heel cap 40 toward the leading end 45 and may terminate at an intermediate location between the opposing ends 45, 47 of the heel cap 40. In some instances, the elongated ridges or other engagement features 48 may taper from one end thereof to the other. The elongated ridges or other engagement features 48 may be arcuate or curvilinear. Advantageously, the elongated ridges or other engagement features 48 may embed in the midsole of a host shoe or other footwear and resist relative motion therebetween, both fore and aft and transversally.

Figure 9:
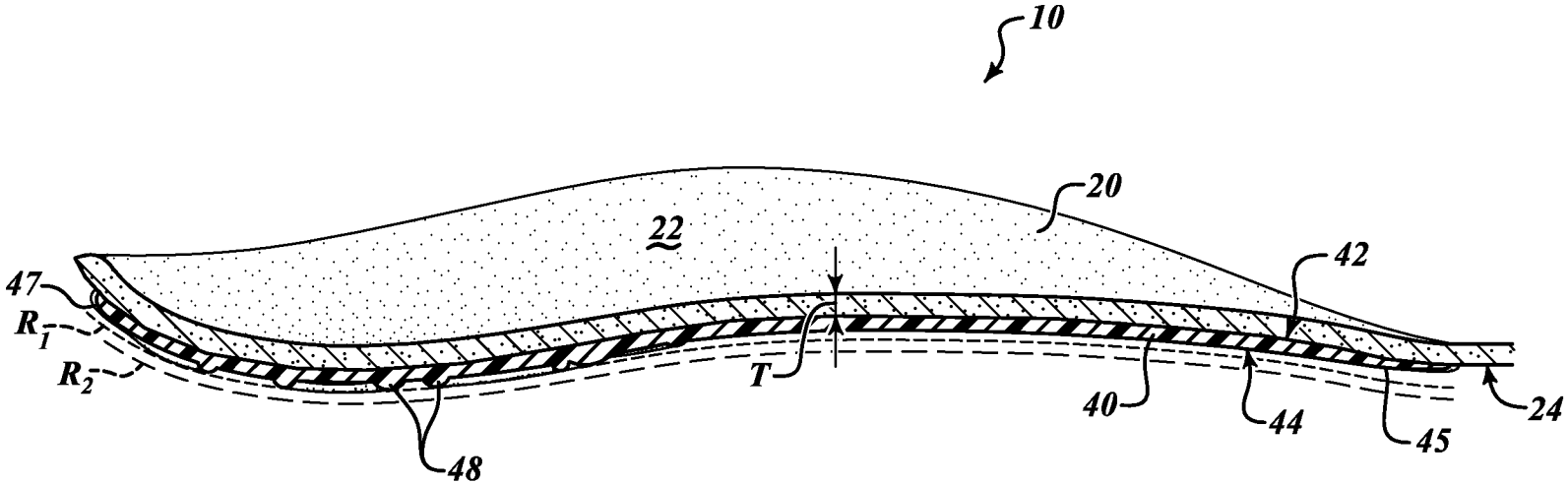
FIG. 9 is a cross-sectional view of the insole assembly of FIG. 1 taken along line 9-9 of FIG. 3.

According to the example embodiment of FIGS. 1 through 9, and with reference in particular to FIG. 9, an entirety of the heel cap 40 may be located within a reference boundary $R_1$ that is offset from the lower contoured surface 24 of the insole base 20 by a generally uniform thickness T of the insole base 20. In other embodiments, an entirety of the heel cap 40 apart from the plurality of engagement features 48 may be located within the reference boundary $R_1$ that is offset from the lower contoured surface 24 of the insole base 20 by the generally uniform thickness T of the insole base 20. In still further embodiments, the entirety of the heel cap 40 (including the plurality of engagement features 48) may be located within a reference boundary $R_2$ that is offset from the lower contoured surface 24 of the insole base 20 by one and one-half times the thickness T of the insole base 20. Accordingly, it will be appreciated that the shape of the heel cap 40, with and without the engagement features 48, may closely track and/or conform to the shape of the insole base 20 at the areas of contact therebetween to provide a particularly sleek, low profile insole assembly 10.

According to some embodiments, including the example embodiment shown in FIGS. 1 through 9, apart from the series of intersecting ridges or other engagement features 48, the heel cap 40 may lack any other projections in the aft end 47 or heel region thereof, such as, for example, posts or other heel support or stiffening features. Further, in some embodiments, a rear heel portion of the upper contoured surface 42 of the heel cap 40 may be rounded and concave to assist in cupping a heel of a user, and a corresponding heel portion of the lower contoured surface 44 at the aft end 47 of the heel cap 40 may mimic the upper contoured surface 42 such that an entirety of the corresponding heel portion of the lower contoured surface 44 is similarly rounded and concave. Again, it will be appreciated that in some instances the shape of the heel cap 40 will closely track and/or conform to the shape of the insole base 20 at the areas of contact therebetween to provide a particularly sleek, low profile insole assembly 10.

According to the example embodiment of FIGS. 1 through 9, and with reference in particular to FIG. 6, at least the forefoot portion 28 of the insole base 20 may include a beveled edge region 30 extending along a periphery 32 thereof. The beveled edge region 30 may taper toward a point at the upper contoured surface 22 of the insole base 20 such that a thickness of the insole base increases with increasing distance inwardly away from an outer edge 34 of the forefoot portion 28 to a generally uniform thickness T of the insole base 20. In some embodiments, the beveled edge region may have a draft angle $\alpha$ of between about 15° and about 35° and may have a leg distance x of between about 0.25 inch and about 0.50 inch. Advantageously, the beveled edge region 30 may assist in enabling the insole assembly 10 to fit within a greater variety of footwear. In addition, the beveled edge region 30 can provide an area at the perimeter of the insole assembly 10 that may be relatively easier to trim to assist in modifying the insole assembly 10 to fit within various shoes or other footwear that may be relatively narrow.

Figure 2:
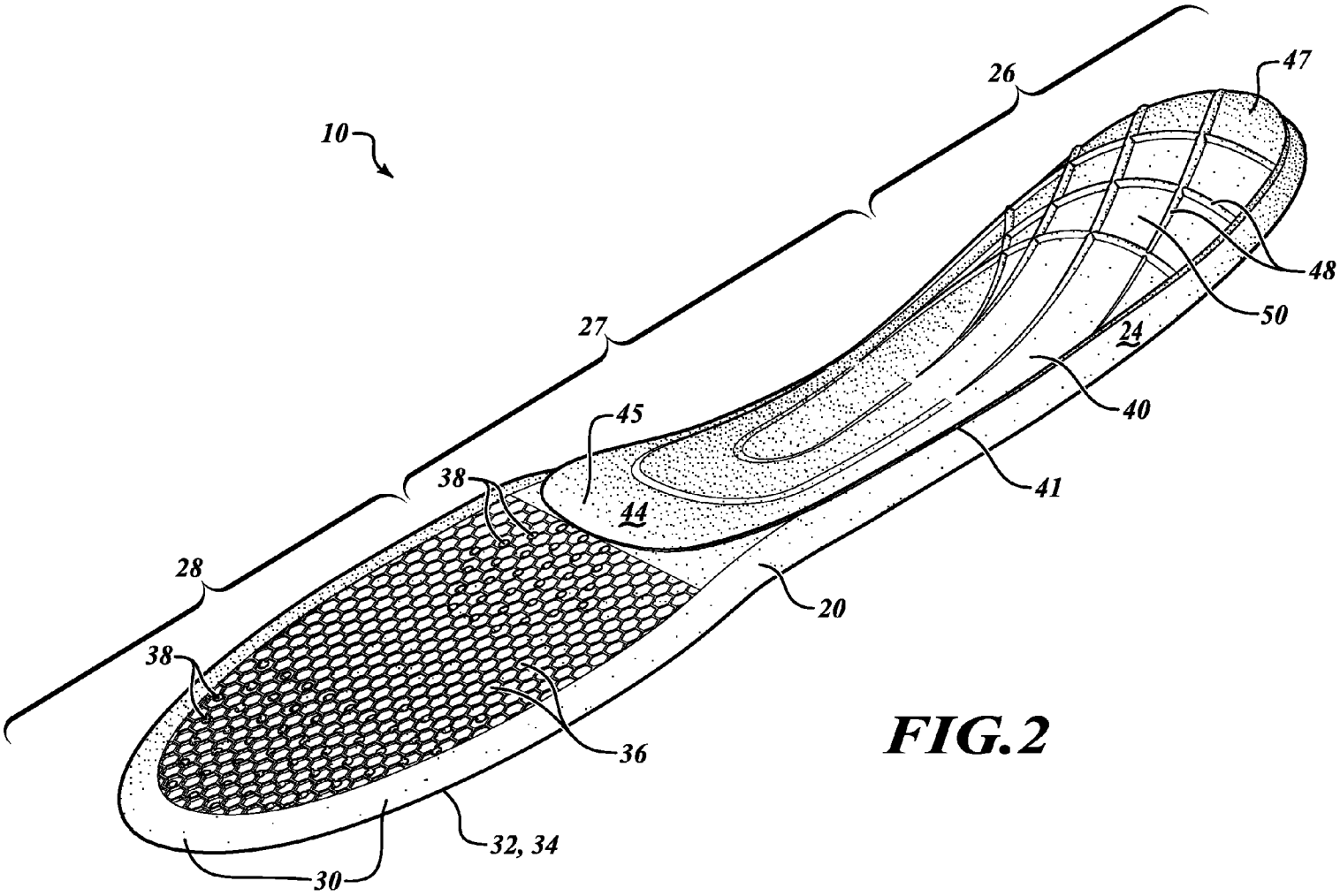
FIG. 2 is an isometric bottom view of the insole assembly of FIG. 1.
Figure 3:
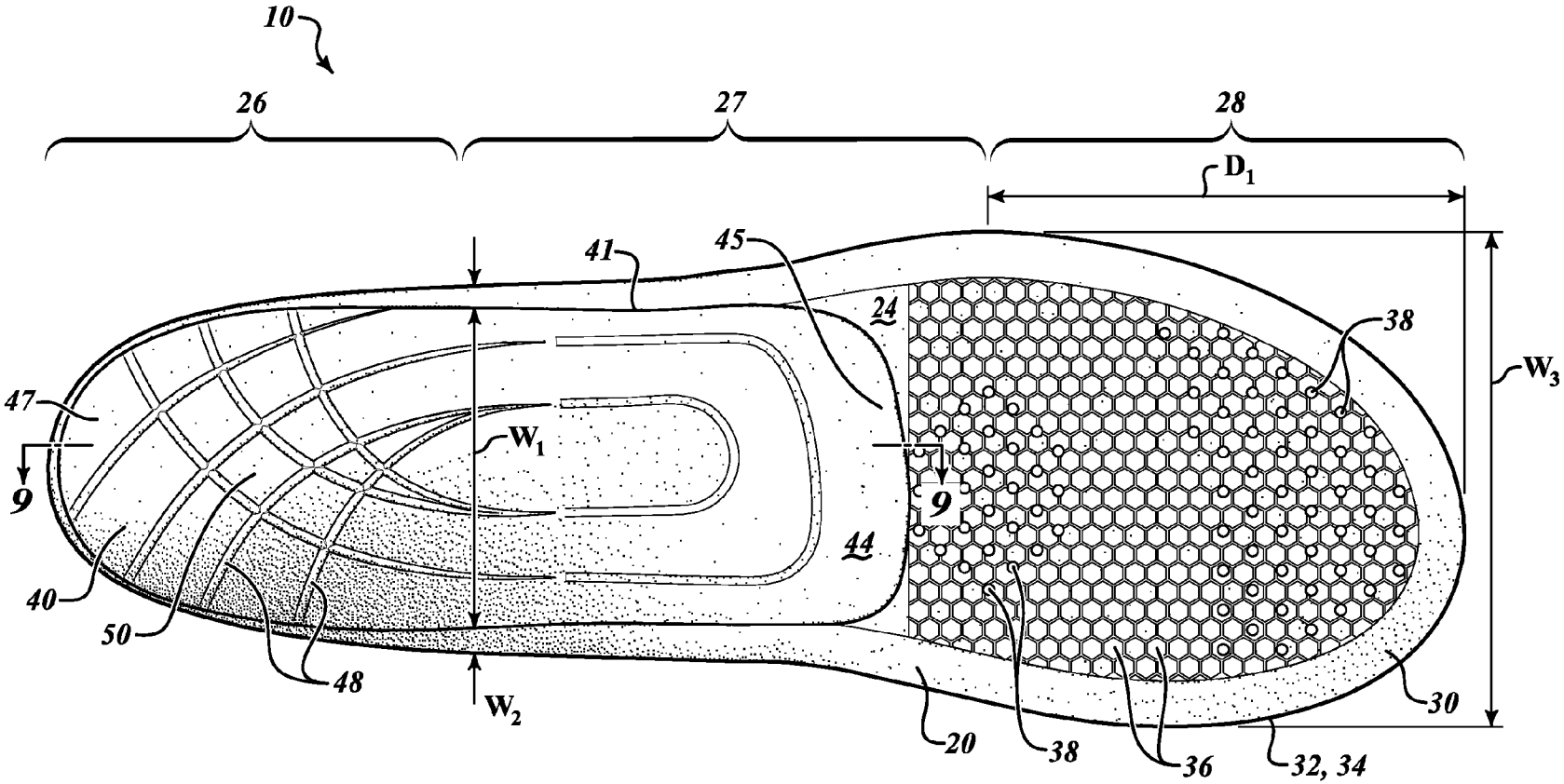
FIG. 3 is a bottom plan view of the insole assembly of FIG. 1.
Figure 4:
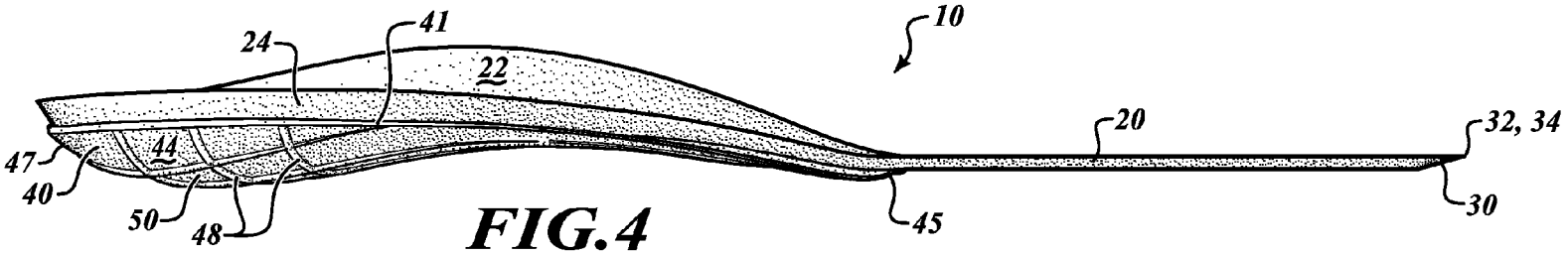
FIG. 4 is an elevational view of a lateral side of the insole assembly of FIG. 1.
Figure 5:
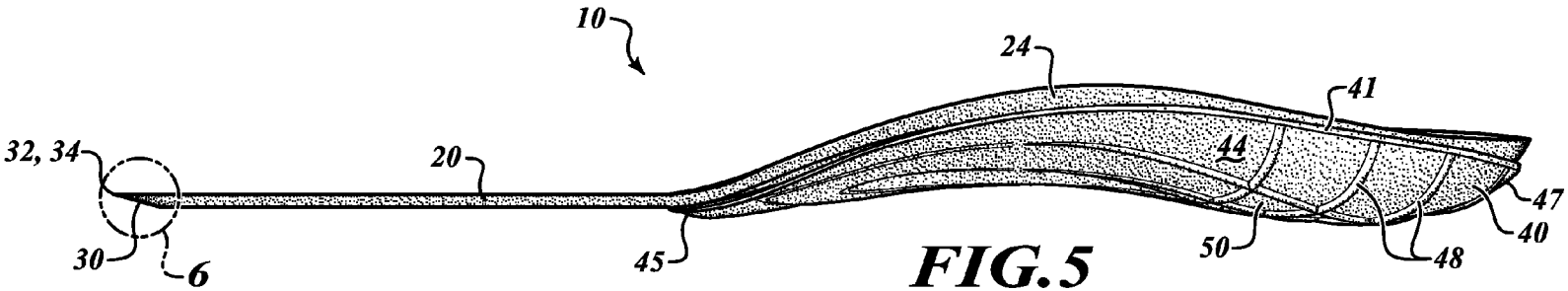
FIG. 5 is an elevational view of a medial side of the insole assembly of FIG. 1.

According to the example embodiment of FIGS. 1 through 9, and with reference in particular to FIG. 3, the heel cap 40 may be relatively narrow such that the insole base 20 extends beyond an outer perimeter 41 of the heel cap 40 in all directions. In addition, a width $W_1$ of the heel cap 40 at a location about midway between opposing ends 45, 47 of the heel cap 40 (and approximately where the rearfoot portion 26 of the insole base 20 transitions to the midfoot portion 27) may be substantially less than a width $W_2$ of the insole base 20 at a corresponding location. For example, the width $W_1$ of the heel cap 40 at the location midway between opposing ends 45, 47 thereof may be at least 0.25 inch less than the width $W_2$ of the insole base 20 at the corresponding location. Additionally, in some instances, a width of the heel cap 40 may be less than a corresponding width of the insole base 20 along the entire length of the heel cap 40. In other embodiments, the heel cap 40 may extend completely between the medial and lateral edges of the insole base 20 in at least one location. Advantageously, in some embodiments, the insole base 20 may overhang the entire outer perimeter 41 of the heel cap 40 to shield plantar surfaces of a user's foot from contacting the heel cap 40 during use.

According to the example embodiment of FIGS. 1 through 9, and with reference in particular to FIG. 3, the forefoot portion 28 of the insole base 20 and the leading end of the midfoot portion 27 may be significantly enlarged and bulbous relative to the rearfoot portion 26 and the trailing end of the midfoot portion 27. For example, in some instances, a ratio of the overall width $W_3$ of the forefoot portion 28 of the insole base 20 relative to the width $W_2$ of the insole base 20 at approximately where the rearfoot portion 26 of the insole base 20 transitions to the midfoot portion 27 may be about 1.35±0.10 or about 1.35±0.05. The forefoot portion 28 may also be particularly squatty. For example, in some instances, a ratio of the overall width $W_3$ of the forefoot portion 28 of the insole base 20 relative to a distance $D_1$ from a point on the lateral edge of the insole base 20 farthest from a centerline of the insole assembly 10 to the leading edge of the insole base 20 may be about 1.00±0.10 or 1.00±0.05. Advantageously, the relatively narrow trailing end of the insole base 20 and the relatively bulbous and squatty leading end of the insole base 20 may allow the insole assembly 10 to be accommodated within a greater range of footwear.

According to the example embodiment of FIGS. 1 through 9, and with reference in particular to FIG. 2, an area of the forefoot portion 28 of the insole base 20 and/or an area of the midfoot portion 27 may include a series of depressions 36 formed on the lowered contoured surface 24 thereof, such as, for example, an array of hexagonal-shaped depressions. A depth of the depressions 36 may vary over a length of the forefoot portion 28. For example, a depth of the depressions 36 may decrease with increasing distance from the toe end of the insole assembly 10. The depressions 36 may be provided for aesthetic purposes and may substantially fill the entire forefoot portion 28 of the insole base 20 apart from a beveled edge region 30 thereof, as shown in FIG. 2. In some instances, the depressions 36 may increase the surface roughness of the lower contoured surface 24 of the insole base 20 and enhance frictional resistance between the insole base 20 and the midsole of the shoe or other footwear into which the insole assembly 10 is inserted during use.

According to the example embodiment of FIGS. 1 through 9, and with reference in particular to FIG. 1, the insole base may include at least one array of perforations 38 extending completely through the forefoot portion 28 and/or the midfoot portion 27 thereof. For example, a first array of perforations 38 may extend completely through a region of the forefoot portion 28 and a second array of perforations may extend completely through a region of the midfoot portion 27. Advantageously, the perforations 38 may assist in reducing the overall weight of the insole assembly 10 and may also increase breathability of the insole assembly 10. Although the perforations 38 are shown as staggered rows of relatively small, cylindrical apertures, it is appreciated that the perforations 38 may vary widely in size, shape and arrangement.

Although certain specific details are shown and described with reference to one example embodiment shown in FIGS. 1 through 9, one skilled in the relevant art will recognize that other embodiments may be practiced without one or more of these specific details. For example, one or more embodiments of an insole assembly may lack the bevel edge region 30 and/or the one or more arrays of perforations 38 shown in the example embodiment of FIGS. 1 through 9. Moreover, aspects and features of the various embodiments described herein can be combined to provide further embodiments.

All of the U.S. patents, U.S. patent application publications, U.S. patent applications, foreign patents, foreign patent applications and non-patent publications referred to in this specification and/or listed in the Application Data Sheet are incorporated herein by reference, in their entirety, including U.S. Provisional Patent Application Ser. No. 61/835,442, filed Jun. 14, 2013, from which the present application claims benefit under 35 U.S.C. §119(e). Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An insole assembly to be inserted in an item of footwear to provide foot support, the insole assembly comprising:

a flexible full-length insole base having an upper contoured surface for engaging a plantar surface of a foot and a lower contoured surface opposite the upper contoured surface, and including a heel portion, a forefoot portion and midfoot portion between the heel portion and the forefoot portion; and a rigid heel cap having an upper contoured surface and a lower contoured surface opposite the upper contoured surface which has the same general contours as the upper contoured surface to define a thin shell structure, the rigid heel cap being bonded to the flexible full-length insole base with the upper contoured surface of the rigid heel cap in contact with the lower contoured surface of the flexible full-length insole base to underlie at least the heel portion thereof and provide support thereto, and the rigid heel cap including a plurality of engagement features protruding from the lower contoured surface thereof to engage a midsole of the item of footwear during use and to resist motion of the insole assembly relative to the midsole, wherein the plurality of engagement features includes a series of elongated, intersecting ridges that protrude from the lower contoured surface, wherein at least one engagement feature extends continuously from the midfoot portion to an aft end of the rigid heel cap.

2. The insole assembly of claim 1 wherein the upper contoured surface of the rigid heel cap has contours that are the same general contours as the lower contoured surface of the heel portion of the flexible full-length insole base such that the rigid heel cap and the flexible full-length insole base nest closely together.

3. The insole assembly of claim 1 wherein a thickness of the thin shell structure defined between the upper and the lower contoured surfaces of the rigid heel cap is generally uniform throughout an entirety of the rigid heel cap.

4. The insole assembly of claim 3 wherein the thickness of the thin shell structure defined between the upper and the lower contoured surfaces of the rigid heel cap narrows slightly with increasing distance away from a heel end of the rigid heel cap.

5. The insole assembly of claim 1 wherein an entirety of the rigid heel cap is located within a reference boundary that is offset from the lower contoured surface of the flexible full-length insole base by a thickness of the flexible full-length insole base.

6. The insole assembly of claim 1 wherein, apart from the plurality of engagement features, an entirety of the rigid heel cap is located within a reference boundary that is offset from the lower contoured surface of the flexible full-length insole base by a thickness of the flexible full-length insole base.

7. The insole assembly of claim 1 wherein the plurality of engagement features protruding from the lower contoured surface of the rigid heel cap are a series of elongated ridges that intersect to provide enhanced structural integrity to at least a rear portion of the heel cap.

8. The insole assembly of claim 1 wherein the plurality of engagement features protruding from the lower contoured surface of the rigid heel cap are a series of intersecting ridges.

9. The insole assembly of claim 8 wherein the series of intersecting ridges intersect to form isolated regions of the lowered contoured surface of the rigid heel cap.

10. The insole assembly of claim 8 wherein, apart from the series of intersecting ridges, the rigid heel cap lacks any other projections in a heel region thereof.

11. The insole assembly of claim 1 wherein a rear heel portion of the upper contoured surface of the rigid heel cap is rounded and concave to cup a heel of a user, and wherein a corresponding heel portion of the lower contoured surface of the rigid heel cap mimics the upper contoured surface such that an entirety of the corresponding heel portion is similarly rounded and concave.

12. The insole assembly of claim 1 wherein the forefoot portion of the flexible full-length insole base includes a beveled edge region extending along a periphery thereof.

13. The insole assembly of claim 12 wherein the beveled edge region tapers toward a point at the upper contoured surface of the flexible full-length insole base such that a thickness of the flexible full-length insole base increases with increasing distance inwardly away from an outer edge of the forefoot portion.

14. The insole assembly of claim 1 wherein the flexible full-length insole base comprises a resiliently compressible foam material and wherein the rigid heel cap comprises a carbon fiber reinforced polymer material.

15. The insole assembly of claim 1 wherein the flexible full-length insole base extends beyond an outer periphery of the rigid heel cap in all directions.

16. The insole assembly of claim 1 wherein a width of the rigid heel cap at a location midway between opposing ends of the rigid heel cap is substantially less than a width of the flexible full-length insole base at a corresponding location.

17. The insole assembly of claim 16 wherein the width of the rigid heel cap at the location midway between opposing ends of the rigid heel cap is at least 0.25 inch less than the width of the flexible full-length insole base at the corresponding location.

18. The insole assembly of claim 1 wherein a width of the rigid heel cap along an entire length of the rigid heel cap is less than a corresponding width of the flexible full-length insole base.

19. The insole assembly of claim 1 wherein the forefoot portion of the flexible full-length insole base includes a series of depressions formed on the lowered contoured surface thereof.

20. The insole assembly of claim 1 wherein the flexible full-length insole base includes an array of perforations extending completely through at least one of the forefoot and midfoot portions thereof.

21. The insole assembly of claim 1 wherein the flexible full-length insole base includes a first array of perforations extending completely through a region of the forefoot portion and a second array of perforations extending completely through a region of the midfoot portion.

22. The insole assembly of claim 1 wherein a ratio of the overall width of the forefoot portion of the insole base relative to a width of the insole base at about where the rearfoot portion of the insole base transitions to the midfoot portion is 1.35±0.10.

23. The insole assembly of claim 1 wherein a ratio of the overall width of the forefoot portion of the insole base relative to a distance from a point on the lateral edge of the insole base farthest from a centerline of the insole assembly to a leading edge of the insole base is 1.00±0.10.

24. A pair of insole assemblies to be inserted in footwear to provide foot support to a user, each insole assembly comprising:

a full-length resiliently compressible foam insole base having an upper contoured surface for engaging a plantar surface of the user's foot and a lower contoured surface opposite the upper contoured surface, and including a heel portion to engage and support a heel of the user's foot, a forefoot portion to support a forefoot of the user's foot, and a midfoot portion therebetween; and a rigid carbon fiber reinforced polymer heel cap having an upper contoured surface and a lower contoured surface opposite the upper contoured surface that mimics the contours of the upper contoured surface to define a thin shell structure, the heel cap being bonded to the insole base with the upper contoured surface of the heel cap in contact with the lower contoured surface of the insole base to underlie the heel portion and provide support thereto, and the heel cap including a plurality of engagement features protruding from the lower contoured surface thereof to engage a midsole of the footwear during use and to resist motion of the insole assembly relative to the midsole, wherein the plurality of engagement features includes a series of elongated, intersecting ridges that protrude from the lower contoured surface, wherein at least one engagement feature extends continuously from the midfoot portion to an aft end of the rigid heel cap.

25. The pair of insole assemblies of claim 24 wherein, for each insole assembly, a thickness of the thin shell structure defined between the upper and the lower contoured surfaces of the heel cap is generally uniform throughout an entirety of the heel cap.

26. The pair of insole assemblies of claim 24 wherein, for each insole assembly, an entirety of the heel cap is located within a reference boundary that is offset from the lower contoured surface of the insole base by a thickness of the insole base.

27. The pair of insole assemblies of claim 24 wherein, for each insole assembly, an entirety of the heel cap apart from the plurality of engagement features is located within a reference boundary that is offset from the lower contoured surface of the insole base by a thickness of the insole base.

28. The pair of insole assemblies of claim 24 wherein, for each insole assembly, a rear heel portion of the upper contoured surface of the heel cap is rounded and concave to cup the heel of the user, and wherein a corresponding heel portion of the lower contoured surface of the heel cap mimics the upper contoured surface such that an entirety of the corresponding heel portion is similarly rounded and concave.

* * * * *